US006092712A

United States Patent [19]

Rueckl

[11] Patent Number: 6,092,712

[45] Date of Patent: Jul. 25, 2000

[54] DEVICE FOR STAPLING STACKED SHEETS OF A RECORDING MEDIUM

[76] Inventor: Michael Rueckl, Unterer Bruehl 10, Aldingen, Germany, D-78554

[21] Appl. No.: 09/405,126

[22] Filed: Sep. 24, 1999

[30] Foreign Application Priority Data

Sep. 25, 1998 [DE] Germany ..... 198 43 869

[51] Int. Cl.[7] ..... B27F 7/02

[52] U.S. Cl. ..... 227/111; 227/110; 227/148; 227/131; 270/37

[58] Field of Search ..... 227/110, 111, 227/148, 101, 131; 270/37

[56] References Cited

U.S. PATENT DOCUMENTS

| | | | |
|---|---|---|---|
| 4,313,670 | 2/1982 | Caldwell | 227/110 |
| 4,903,952 | 2/1990 | Russel et al. | 227/111 |
| 5,092,509 | 3/1992 | Naito et al. | 227/111 |
| 5,106,066 | 4/1992 | Shea et al. | 227/131 |
| 5,791,544 | 8/1998 | Fujimaki | 227/131 |
| 5,842,624 | 12/1998 | Ishida | 227/148 |

*Primary Examiner*—Scott A. Smith
*Attorney, Agent, or Firm*—Higgs, Fletcher & Mack; Bernard L. Kleinke

[57] ABSTRACT

A stapling attachment is positioned on a movable carriage. The stapling attachment can be pivoted relative to the carriage. At a predetermined position of the travel path of the carriage a capture mechanism engages a bolt disposed eccentrically with respect to a pivot axle of the stapling attachment. The stapling attachment is automatically pivoted into an oblique position through the reverse movement of the carriage so that a staple may be inserted at an oblique angle of a sheet stack.

7 Claims, 5 Drawing Sheets

DEVICE FOR STAPLING STACKED SHEETS OF A RECORDING MEDIUM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention is stapling mechanisms. More specifically, the invention relates to a device for stapling stacked sheets of a recording medium for a business machine.

2. Background Art

In business machines such as printers, copiers and the like, a means is frequently provided for stapling with staples the sheets output by the business machine in stacked form. For this purpose a conventional stapling attachment feeds staples through a magazine and inserts the staples into the sheet stack by means of an ejection mechanism. The stapling attachment can be moved parallel to one alignment edge of the stack of sheets such that the staples are inserted parallel to the edge of the stack and aligned on the alignment edge.

However, it would be highly desirable to staple the stack of sheets in the upper left corner of the stack with a staple placed obliquely to the edge. Such an oblique placement of the staple would facilitate turning over the individual sheets of the stack. Known stapling attachments for business machines do not provide for the automatic stapling of a stack of sheets with a staple placed obliquely with respect to the alignment edge.

SUMMARY OF THE INVENTION

It is therefore an object of the present invention to provide a device for automatically stapling a stack of sheets together with an obliquely positioned staple. To overcome the disadvantages in the prior art and meet the objective of the invention, herein is disclosed a novel device for stapling stacked sheets. The device for stapling stacked sheets has a stapling attachment, substantially structured conventionally, disposed on a carriage which can be moved parallel to the alignment edge of a sheet stack. The stapling attachment can be pivoted relative to the carriage to a position in which an obliquely placed staple can be inserted into the sheet stack.

Advantageously, the capture mechanism subsequently releases the stapling attachment so that the stapling attachment can return again into its nonpivoted basic position on the carriage.

The capture mechanism makes possible the automatic pivoting of the stapling attachment into the desired oblique position without a separate driving means and a separate control being required for the pivot movement of the stapling attachment. The entire driving and the entire control of the pivot movement is exclusively carried out by the controlled driving of the carriage, which is necessary and already present.

DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MADE FOR CARRYING OUT THE INVENTION

Figure 1:
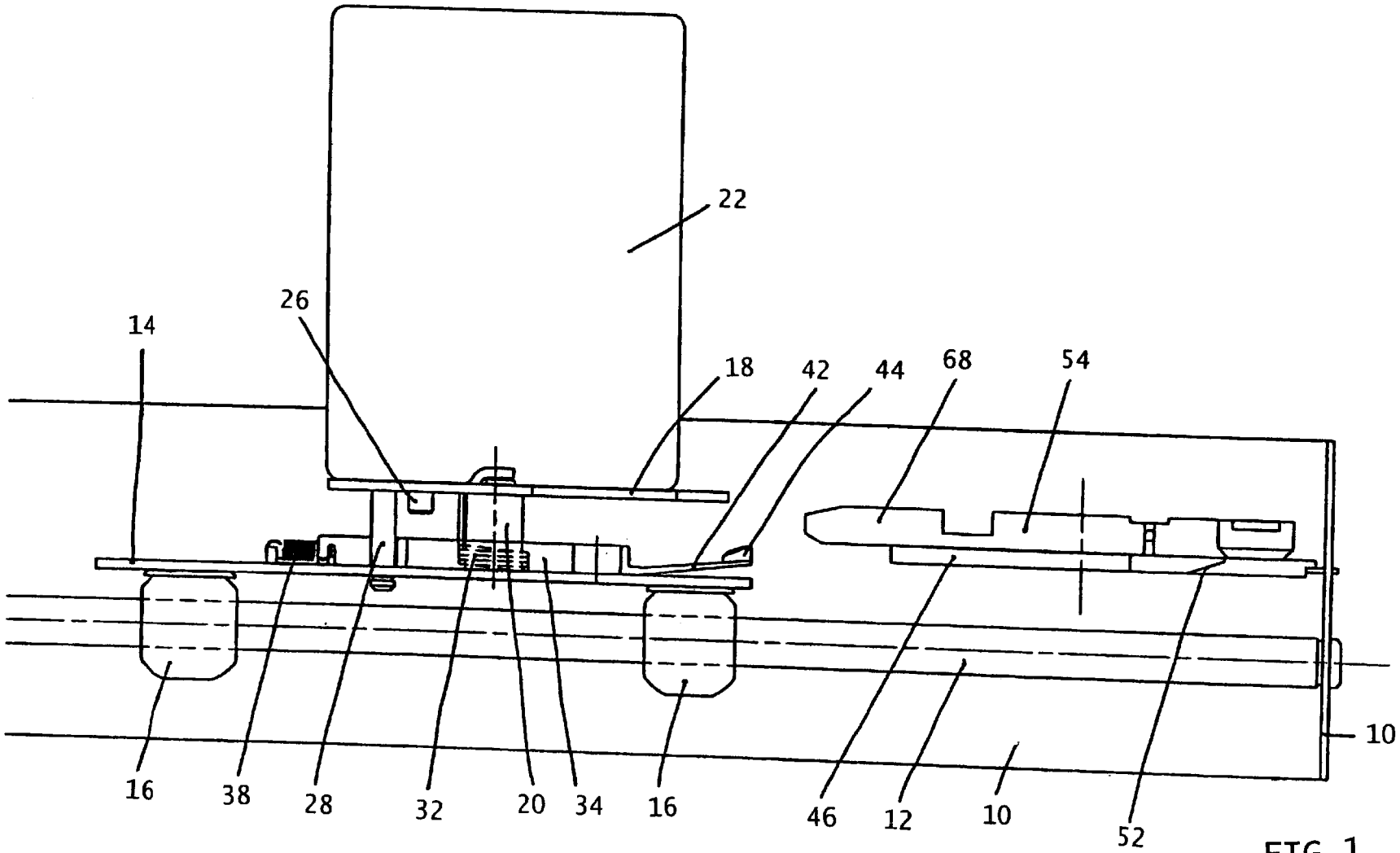
FIG. 1 is a lateral view of a device for stapling made in accordance with the present invention and showing the device in a basic position.

The device for stapling stacked sheets is placed as a stapler module on a sheet output of a business machine. A base of the device comprises a frame 10 whose longitudinal edge extends parallel to the alignment edge of the sheets output and stacked by the business machine. In the frame 10 is disposed a guide 12 parallel to the longitudinal edge. A carriage 14 is movable by means of guide bearings 16 on the guide 12. The carriage 14 is driven under control by a motor (not shown) via a rotating toothed belt (not shown). The carriage 14 substantially comprises a plate disposed parallel to the plane of carriage displacement and parallel to the sheet stack (not shown).

The carriage 14 supports a pivot plate 18 which is disposed parallel to the carriage 14. The pivot plate is pivotable relative to the carriage 14 about a pivot axle 20. The pivot axle 20 is preferably formed by a sleeve riveted into the pivot plate 18. A shaft insert, comprising a synthetic material is pressed into the sleeve. A bearing bolt is set in the shaft insert, and riveted into the carriage 14. By structuring the pivot axle 20 in this way, the pivot plate 18 is stably, and at a spacing, supported on carriage 14. On the pivot plate 18 is attached a stapling attachment 22. Such a stapling attachment is well known in the art and will not be addressed in detail. The stapling attachment 22 includes a staple magazine and a staple ejection mechanism.

The stapling attachment 22 is positioned by means of the pivot plate 18 and the carriage 14 such that the staple ejection channel 24 is disposed on the longitudinal edge of frame 10 and is disposed in the region of the side edge of an aligned stack of sheets. During the movement of the carriage 14 on the guide 12 the staple ejection channel 24 moves parallel along the longitudinal side of frame 10.

On the underside of the pivot plate 18 is attached a bolt 26 projecting toward the carriage 14. The bolt 26 is attached eccentrically with respect to the pivot axle 20. Also attached on the underside of the pivot plate 18 is a locking pin 28, which is attached eccentrically to the pivot axle 20 and perpendicularly to the pivot plate 18. The locking pin 28 engages an arcuate cutout 30 of carriage 14. The arcuate cutout 30 extends on a circular arc concentric with the pivot axle 20 such that the locking pin 28 can travel in this arcuate cutout 30 if the pivot plate 18 is pivoted with respect to the carriage 14.

Figure 2:
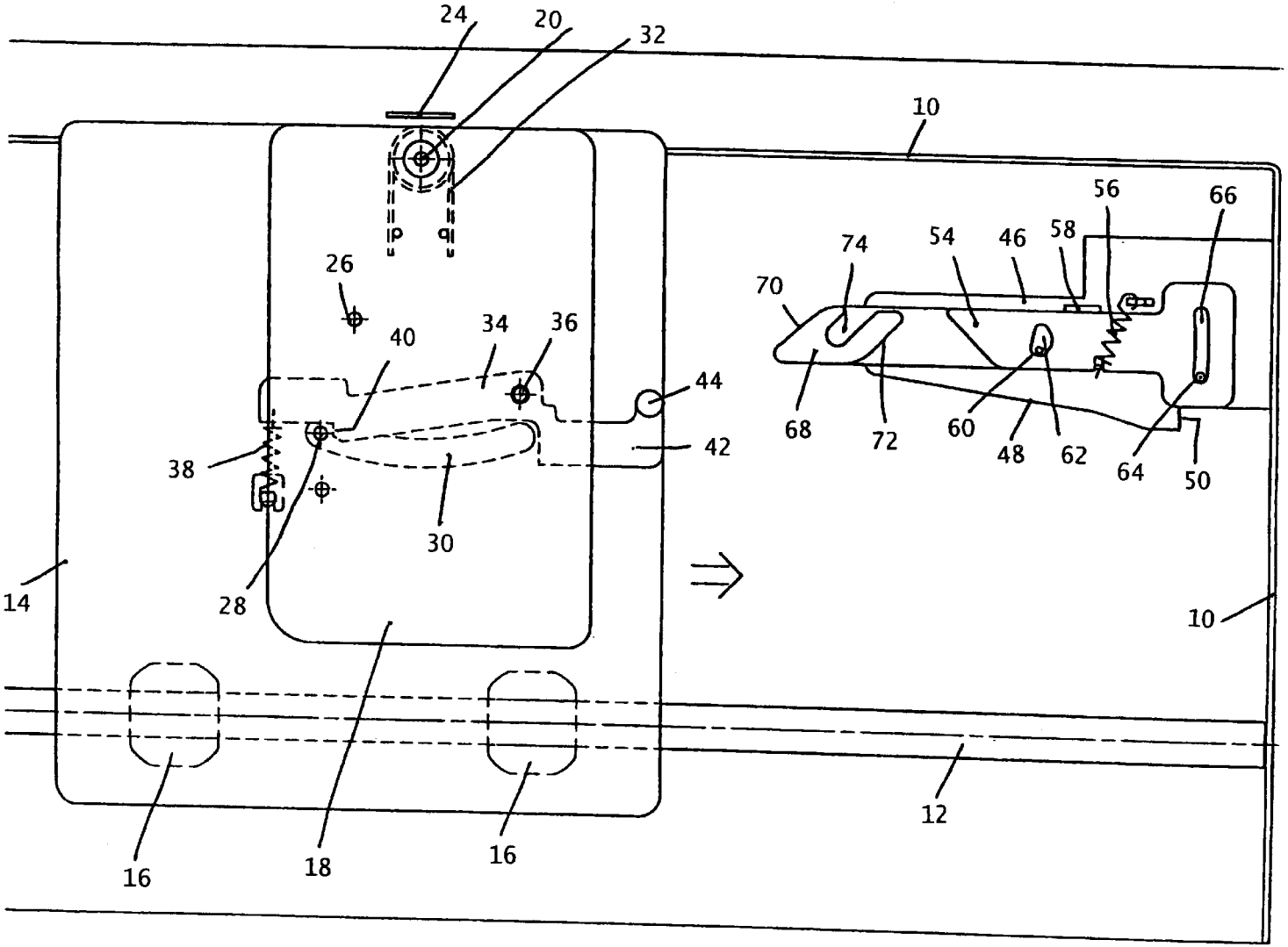
FIG. 2 is a top view of the device shown in FIG. 1 in a basic position.

Coiled around the pivot axle 20 is a helical leg spring 32 with one leg of the spring secured on the pivot plate 18 and the other leg of the spring secured on carriage 14. In such a manner, the helical leg spring 32 prestresses the pivot plate 18 against the carriage 14 in the pivot direction when the locking pin 28 is positioned on the left end of the arcuate cutout 30 (as shown in FIG. 2). In this position the stapling attachment 22 is disposed perpendicularly to the longitudinal edge of the frame 10 and the staple ejection channel 24 extends parallel to this longitudinal edge.

A stop lever 34 is on the upper side of carriage 14 and is supported pivotable about a pivot point 36 in a plane parallel to carriage 14. The stop lever 34 is a two-armed lever, comprising a left-lever arm and a right-lever arm (as shown in FIG. 2). At the left-lever arm of the lever 34, a tension spring 38 engages the left-lever arm with the other end of the spring 38 is secured on the carriage 14. The left lever arm comprises a latching projection 40 which, in the basic position shown in FIG. 2, retains the locking pin 28 if the locking pin 28 is at the left end of the arcuate cutout 30. If this latching lever 34 is pivoted against the force of the tension spring 38 (in FIGS. 2–4) in the clockwise direction—the left lever arm of the latching lever 34 moves away from the locking pin 28 and the latching projection 40 releases the locking pin 28.

The right-lever arm of the latching lever 34 is formed as a spring leg 42 bent away from the carriage 14 in the upward direction. On the spring leg, at its free outer end, a sloped ramp pin 44 is directed upwardly toward the pivot plate 18.

On the right transverse side of frame 10 (see FIGS. 2–4) a ledging 46 is fastened. The ledging 46 is disposed parallel to the plane of the carriage 14 and the pivot plate 18 and projects perpendicularly from frame 10 at such a height that the ledging 46 can engage between the carriage 14 and pivot plate 18. The ledging 46 has implemented on its one longitudinal edge an unlatching slope 48 that is generally perpendicular to the transverse wall of frame 10. On the frame-side end of this unlatching slope 48 is formed an edge 50 parallel to the frame 10, which, on the underside of the ledging 46, is implemented as a ramp 52.

A capture lever 54 is supported on the upper side of ledging 46. The capture lever 54 is in contact on the upper side of ledging 46 and is retained by a tension spring 56 on a stop 58 of the ledging 46. The capture lever 54 is movable on the ledging 46 against the force of the tension spring 56. For this purpose, a first pin 60 penetrates the ledging 46 through an aperture 62 in the central region of the capture lever 54 such that it can be pivoted with play about this first pin 60. The pivot movement of capture lever 54 is guided thereby such that a second pin 64 of ledging 46 penetrates through a circular arc-form guide slot 66 of the frame-side end of capture lever 54.

A cardioid cam 68 is implemented the upper side of the capture lever 54. The cam 68 is on the end of the capture lever 54 that faces away from frame 10 and is directed toward the carriage 14. The cardioid cam 68 comprises a lead-in slope 70 on its carriage-side edge and a lead-out slope 72 parallel to this lead-in slope 70 on its frame-side edge. Between the lead-in slope 70 and the lead-out slope 72 is disposed a latching recess 74.

The operational function of the device will now be described. In such a manner the mutual spatial configuration of the individual elements will also be evident.

In FIG. 2 the device is shown in its basic position. The pivot plate 18, with the stapling attachment 22 is also in the basic position whereby the pivot plate 18 is disposed perpendicularly to the longitudinal edge of frame 10. In this basic position the stapling attachment 22 is held thereby such that the latching projection 40 of the latching lever 34 retains the locking pin 28 in the left end of the arcuate cutout 30 of the carriage 14 (as shown in FIG. 2).

In this basic position of the stapling attachment 22, the carriage 14 can be moved by means of the motor drive into any desired position in which a staple is to be driven into the sheet stack in parallel to the margin edge of the sheet stack.

Figure 3:
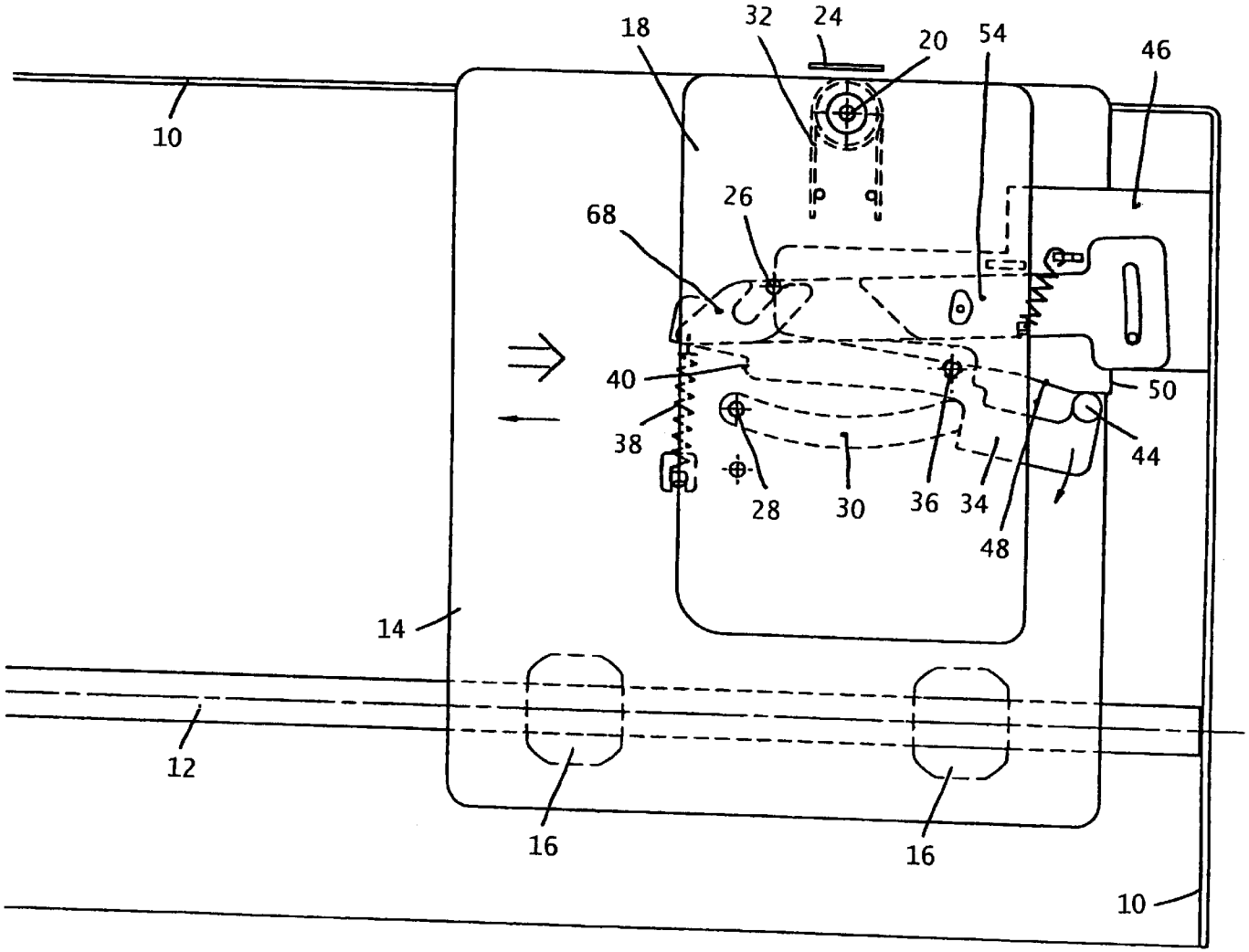
FIG. 3 is a top view of the device shown in FIG. 1 in a capture position.

However, if a staple is to be driven into the sheet stack at an oblique angle with respect to the longitudinal edge of the stack, the carriage 14 is moved in the direction of the arrow in FIG. 2 toward the capture mechanism. When the carriage 14, with the stapling attachment 22, reaches the capture mechanism, the bolt 26 cooperates with the cardioid cam 68 of the capture lever 54. Further, the ramp pin 44 of the latching lever 34 cooperates with the unlatching slope 48 of the ledging 46. In this process the bolt 26 comes to rest on the lead-in slope 70 of the cardioid cam 68 and presses the capture lever 54 away against the force of the tension spring 56 such that the bolt 26 enters into the latching recess 74 via the lead-in slope 70. Simultaneously the ramp pin 44 moves along the unlatching slope 48 of the ledging 46 so that the latching lever 34 is pivoted in the clockwise direction against the force of the tension spring 38 about the pivot point 36. Thereby the latching lever 34 is raised off the locking pin 28 and the latching projection 40 of the latching lever 34 releases the locking pin 28, as shown in FIG. 3.

Figure 4:
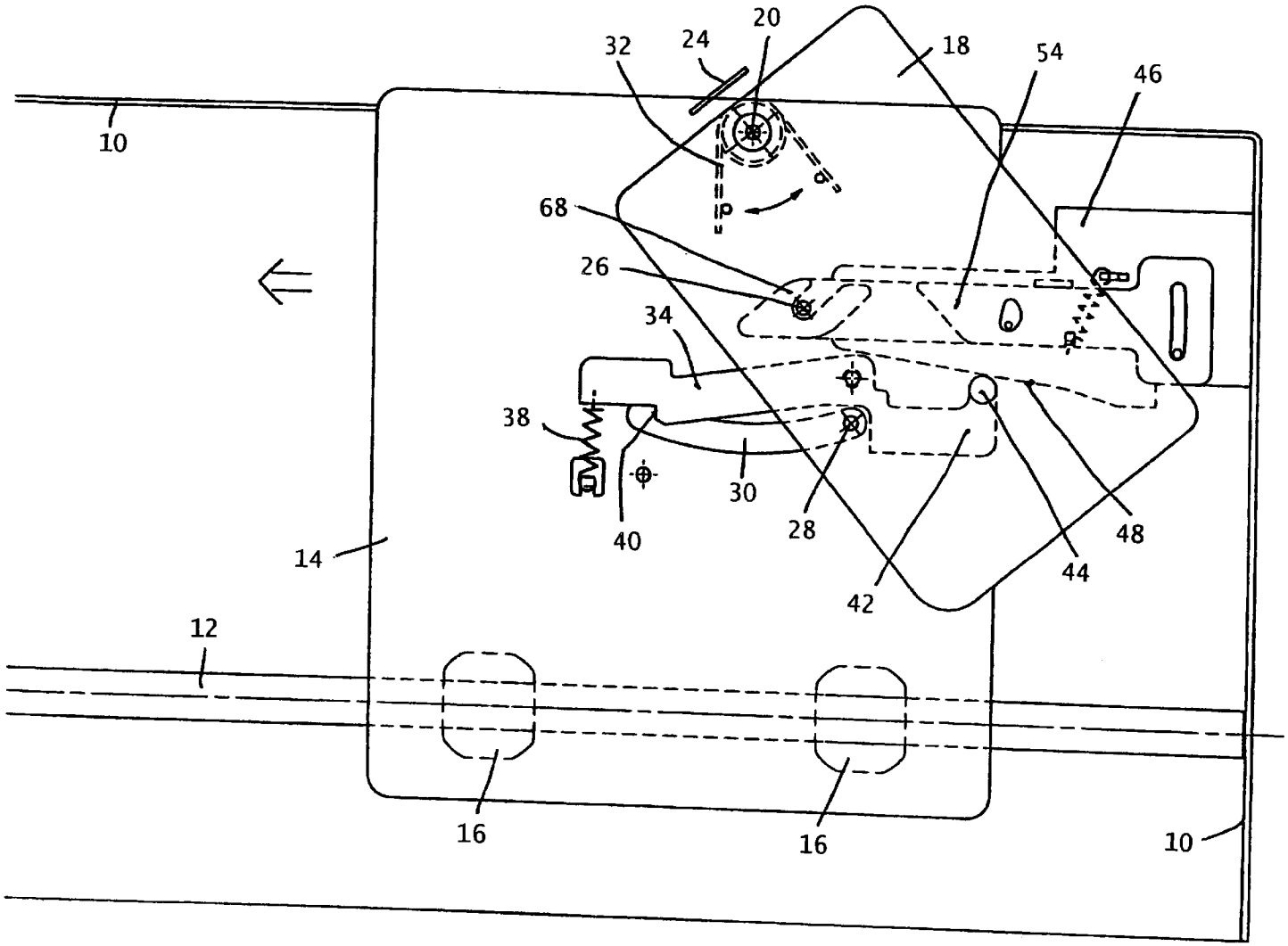
FIG. 4 is a top view of the device shown in FIG. 1 in a pivoted position.

The direction of rotation of the driving motor is subsequently reversed such that the carriage 14 now moves backward, i.e. to the left as indicated in FIG. 4 by the arrow. Thereby the carriage 14 and the pivot axle 20 move toward the left while the bolt 26 drops into the latching recess 74 and thus is retained by the cardioid cam 68. The retention of bolt 26 and the movement of the pivot axle 20 lead to a pivoting of the stapling attachment 22 relative to carriage 14 as is shown in FIG. 4. During this pivoting movement the released locking pin 28 migrates in the arcuate cutout 30 to the right, and the helical leg spring 32 is tensioned. In this pivot position (shown in FIG. 4) the staple ejection channel 24 of the stapling attachment 22 is positioned at an angle of, for example, approximately 40° with respect to the longitudinal side of frame 10 and thus obliquely with respect to the longitudinal edge of the sheet stack. Now a staple can be driven in this oblique position into the sheet stack.

Figure 5:
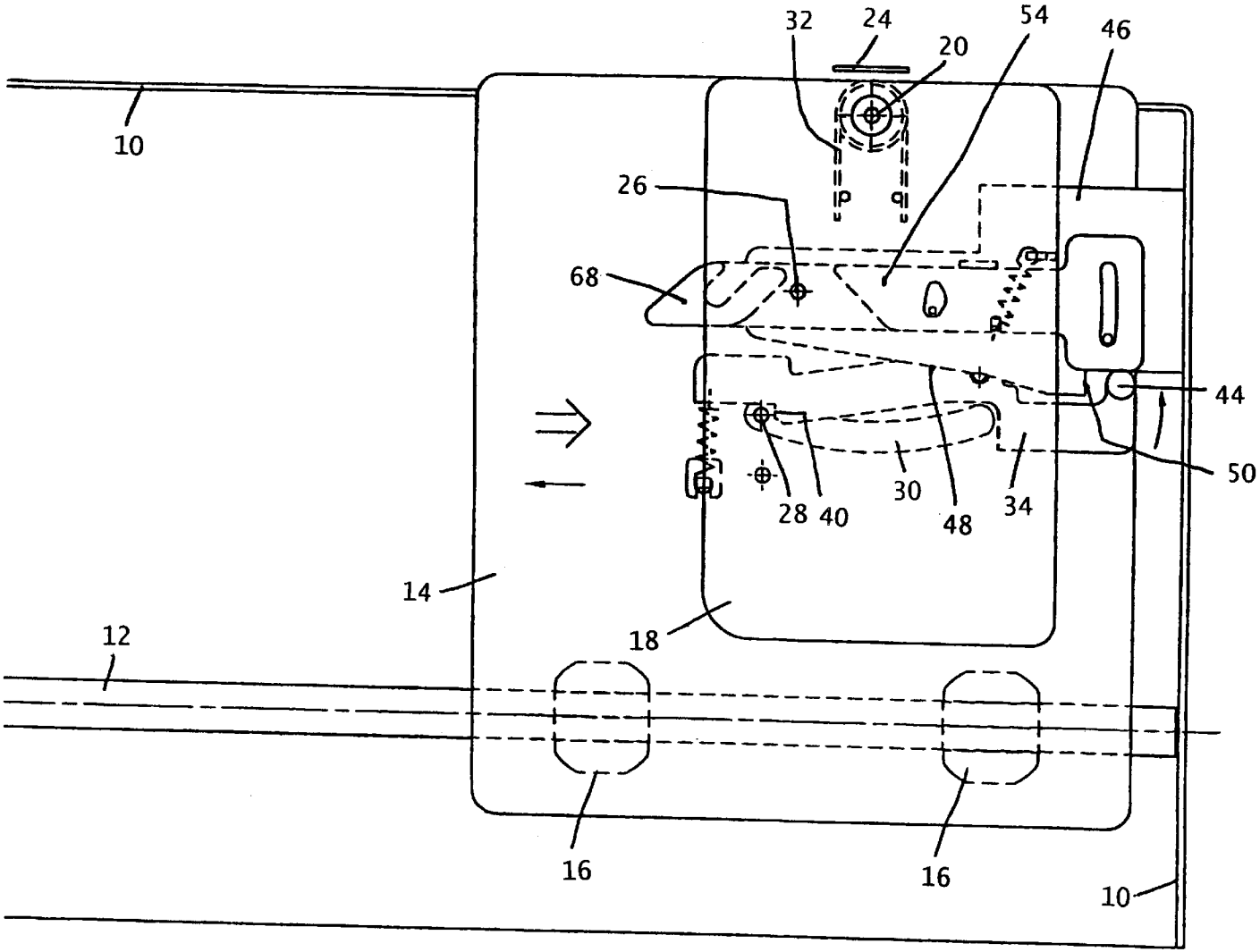
FIG. 5 is a top view of the device shown in FIG. 1 in a released position.

Subsequently the direction of rotation of the driving motor is again reversed so that the carriage 14 is moved again to the right as is indicated by the arrow in FIG. 5. During this movement the bolt 26 migrates again from the latching recess 74 and presses the capture lever 54 again against the force of the tension spring 56 in the counterclockwise direction such that the bolt 26 moves out of the latching recess 74 and enters behind the frame-side lead-out slope 72 of the cardioid cam 68. The ramp pin 44 migrates simultaneously beyond the unlatching slope 48 and drops behind the edge 50 of the ledging 46 due to the effect of the tension spring 38 in the counterclockwise direction. During this movement the helical leg spring 32 pivots the pivot plate 18 with the stapling attachment 22 back again into the basic position with the locking pin 28 moving again in the arcuate cutout 30 to the left end of the arcuate cutout 30 (as shown in FIG. 5). Since the latching lever 34, after it drops behind edge 50, is no longer pivoted out of its basic position, the locking pin 28 latches now behind the latching projection 40 of the latching lever 34. The device is now in the position shown in FIG. 5.

The direction of rotation of the driving motor is again reversed so that the carriage 14 moves again to the left, as indicated in FIG. 5 by the small arrow. The bolt 26 now travels over the lead-out slope 72 past the cardioid cam 68, with the capture lever 54 being pivoted in the clockwise direction against the force of the tension spring 56. The ramp pin 44 slides with its sloped upper front face over the ramp 52 formed onto the underside of edge 50, and, due to the elasticity of the spring leg 42 of the latching lever 34, the ramp pin 44 can slide through under the ledging 46. Since the latching lever 34 is not pivoted, the locking pin 28 remains captured behind the latching projection 40 of the latching lever 34 and thus the stapling attachment 22 is stably retained in its basic position during this movement back of the carriage 14. In this way the entire device enters again into its starting position shown in FIG. 2.

In a simplified embodiment , th e capture mechanism comprises a cardioid mechanism which retains the eccentric bolt for pivoting the stapling attachment. The eccentric bolt enters in the forward direction, and, in a succeeding renewed forward movement, releases the bolt again. In the simplified embodiment, no active elements are required for the capture and the release of the bolt so that not only a simple construction system results but also, no additional control measures are required.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A Device for stapling a sheet stack of a recording medium, comprising:

a carriage that can be driven in a plane parallel to an alignment edge of the sheet stack;

a stapling attachment disposed on the carriage so that the stapling attachment can be moved along the alignment edge;

a pivot axle between the carriage and the stapling attachment so that the stapling attachment is pivotable perpendicular to the plane of movement of the carriage;

a capture mechanism disposed in a predetermined position of a travel path of the carriage; and wherein with a forward motion of the carriage the capture mechanism captures the stapling attachment and retains it eccentrically relative to the pivot axle and with a reverse movement of the carriage the stapling attachment is placed into an oblique staple position relative to the carriage, and wherein the capture mechanism further releases the stapling attachment for resetting the stapling attachment.

2. The Device for stapling according to claim 1 wherein the stapling attachment further includes a bolt, disposed eccentrically to the pivot axle, which the capture mechanism engages.

3. The Device for stapling according to claim 2, wherein the capture mechanism comprises a cardioid cam mechanism with which the bolt cooperates.

4. The Device for stapling according to claim 3 wherein the cardioid cam mechanism is implemented on a movably supported capture lever.

5. The Device for stapling according to claim 1, wherein the stapling attachment in a nonpivoted basic position is detachably latched.

6. The Device for stapling according to claim 5, wherein the stapling attachment in the basic position is latched by a latching lever, which travels against an unlatching means and thereby the latching lever is pivoted into a position for releasing the stapling attachment.

7. The Device for stapling according to claim 6, wherein the stapling attachment further includes a locking pin which is latched through a latching projection of the latching lever and the latching lever travels against an unlatching slope.

* * * * *